US011712795B2

(12) United States Patent
Koehler

(10) Patent No.: US 11,712,795 B2
(45) Date of Patent: Aug. 1, 2023

(54) WHEELED STORAGE CONTAINER APPARATUS

(71) Applicant: Paul Koehler, Perkasie, PA (US)

(72) Inventor: Paul Koehler, Perkasie, PA (US)

( * ) Notice: Subject to any disclaimer, the term of this patent is extended or adjusted under 35 U.S.C. 154(b) by 99 days.

(21) Appl. No.: 17/203,860

(22) Filed: Mar. 17, 2021

(65) Prior Publication Data

US 2022/0297282 A1 Sep. 22, 2022

(51) Int. Cl.

| | |
|---|---|
| ***B25H 3/02*** | (2006.01) |
| ***A45C 13/02*** | (2006.01) |
| ***A45C 13/28*** | (2006.01) |
| ***B25H 3/06*** | (2006.01) |
| ***A45C 5/14*** | (2006.01) |

(52) U.S. Cl.

CPC ..... *B25H 3/022* (2013.01); *A45C 5/14* (2013.01); *A45C 13/02* (2013.01); *A45C 13/28* (2013.01); *B25H 3/06* (2013.01); *A45C 2013/026* (2013.01)

(58) Field of Classification Search

CPC ..... B65F 1/16; A45C 5/04; B25H 3/06
USPC ..... 220/694
See application file for complete search history.

(56) References Cited

U.S. PATENT DOCUMENTS

| | | | | |
|---|---|---|---|---|
| 3,711,110 | A * | 1/1973 | Logerquist | B25H 3/02 280/37 |
| 5,102,001 | A * | 4/1992 | Teague | B65F 1/1615 220/908 |
| 5,118,000 | A * | 6/1992 | Howell | B65F 1/122 414/407 |
| 5,396,974 | A * | 3/1995 | Pedlar | A45C 5/02 280/37 |
| 5,823,550 | A * | 10/1998 | Bennett | A45C 5/04 280/33.998 |
| 5,893,572 | A | 4/1999 | Parks | |
| D501,285 | S | 1/2005 | Long, Jr. | |
| 6,851,288 | B2 * | 2/2005 | Howes | B65F 1/1615 70/164 |
| 7,278,644 | B2 | 10/2007 | Villarreal | |
| 9,277,796 | B1 | 3/2016 | Elam | |
| 10,173,315 | B2 | 1/2019 | Giamanco | |
| 10,618,730 | B2 * | 4/2020 | Manssourian | B65F 1/1615 |
| 10,661,818 | B2 | 5/2020 | Guirlinger | |
| 11,247,840 | B1 * | 2/2022 | Pearce | B65F 1/068 |

(Continued)

FOREIGN PATENT DOCUMENTS

WO WO2005028163 3/2005

*Primary Examiner* — Ernesto A Grano
*Assistant Examiner* — Symren K Sanghera

(57) ABSTRACT

A wheeled storage container apparatus for storing and transporting tools and equipment includes a body having a body back side with a drop lip portion extending down from proximal a body top side and defining a catch cavity to hook onto a railing. A lid is coupled to a body front side to selectively cover or expose the body top side. A pair of wheels is coupled to the body. A tray has a tray rim selectively engageable with the body top side and a plurality of tray compartments extending down into the body inside. A locking arm has a pivot portion pivotably coupled to the drop lip portion of the body back side, an arm portion extending from the pivot portion, and a catch portion extending from the arm portion. The catch portion is selectively engageable with the lid to maintain the lid in a closed position.

10 Claims, 9 Drawing Sheets

(56) References Cited

U.S. PATENT DOCUMENTS

| | | | | |
|---|---|---|---|---|
| 2003/0178920 | A1* | 9/2003 | Ambriz | A47B 81/00 312/287 |
| 2008/0007146 | A1* | 1/2008 | Hillman | G07D 11/125 312/183 |
| 2008/0142322 | A1* | 6/2008 | Barker | A45C 9/00 220/4.03 |
| 2008/0257887 | A1* | 10/2008 | Hodge | B65F 1/1615 220/315 |
| 2011/0232805 | A1 | 9/2011 | DeSpain | |
| 2016/0137412 | A1* | 5/2016 | Capetillo | B65F 1/085 220/529 |
| 2018/0319589 | A1* | 11/2018 | Foster | B65F 1/1473 |
| 2019/0382199 | A1* | 12/2019 | Nolet | B65F 1/122 |
| 2020/0231380 | A1* | 7/2020 | Kinder | B65F 1/1646 |

* cited by examiner

WHEELED STORAGE CONTAINER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to storage devices and more particularly pertains to a new storage device for storing and transporting tools and equipment. The present invention includes an upright body having a pair of wheels. The body has a notch to hang off the side of a lift cage as well as a locking arm to secure a cover in place.

(2) Description of Related Art Including Information Disclosed Under 37 CFR 1.97 and 1.98

The prior art relates to storage devices. Known storage devices typically have front shelving and are not designed to be top-access only. These devices also lack a means of hanging from a railing or cage. Known devices also lack a locking arm that can serve to lock the lid in place as well as act as a handle.

(h) BRIEF SUMMARY OF THE INVENTION

An embodiment of the disclosure meets the needs presented above by generally comprising a body having a body front side, a body back side, a body left side, a body right side, an open body top side, and a body bottom side defining a body inside. The body back side has a drop lip portion extending down from proximal the body top side and defining a catch cavity. The catch cavity is configured to hook onto a railing. A lid is coupled to the body. The lid is hingingly coupled to the body front side to selectively cover or expose the body top side. A pair of wheels is coupled to the body left side and the body right side adjacent the body back side. Each wheel extends to be aligned with a bottom support portion of the body bottom side and extends past the body back side. A tray is coupled to the body. The tray has a tray rim selectively engageable with the body top side and a plurality of tray compartments extending down into the body inside. A locking arm is coupled to the body. The locking arm has a pivot portion pivotably coupled to the drop lip portion of the body back side, an arm portion extending from the pivot portion, and a catch portion extending from the arm portion. The catch portion is selectively engageable with the lid to maintain the lid in a closed position covering the body top side.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
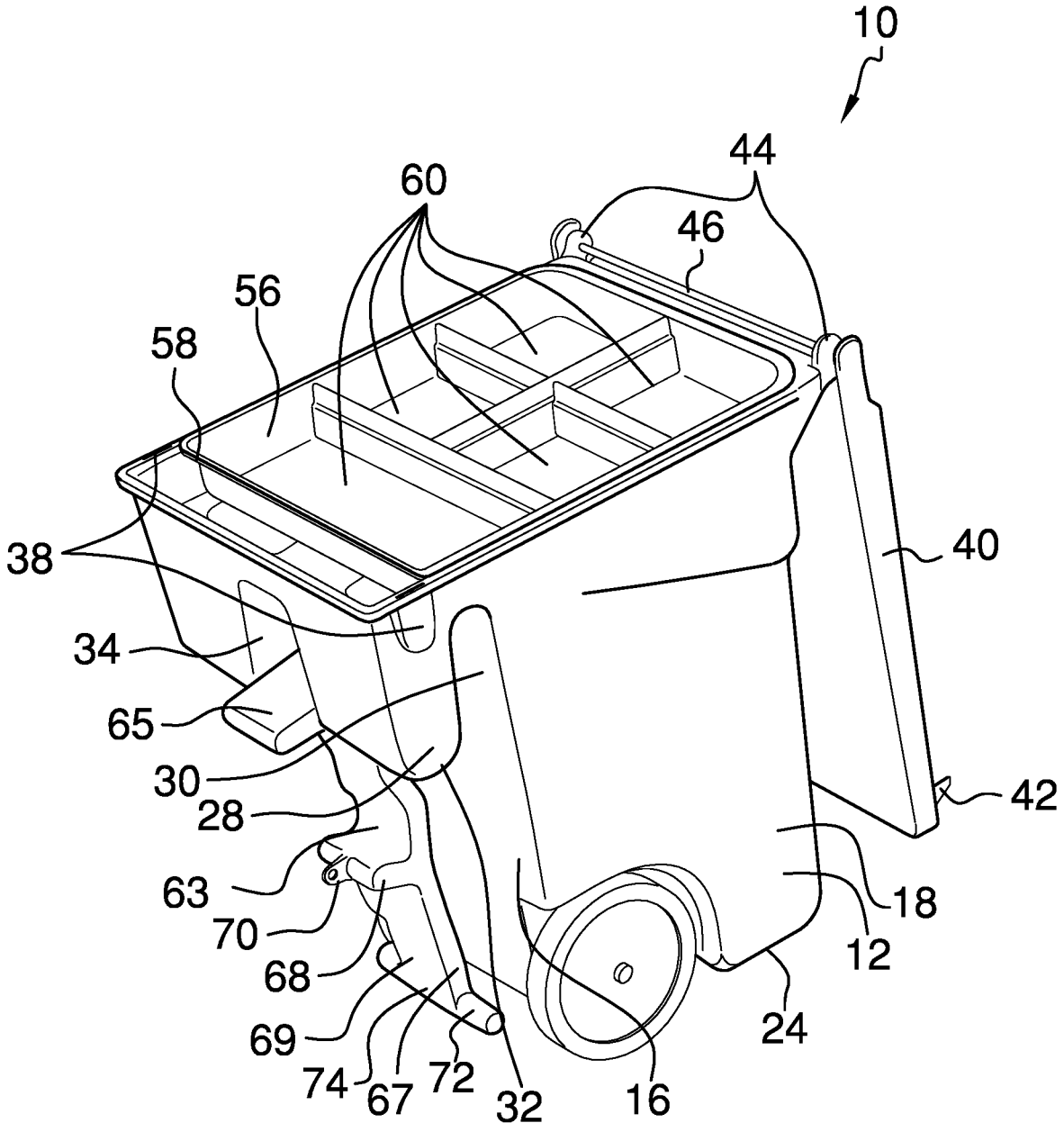
FIG. 1 is an isometric view of a wheeled storage container apparatus according to an embodiment of the disclosure.
Figure 2:
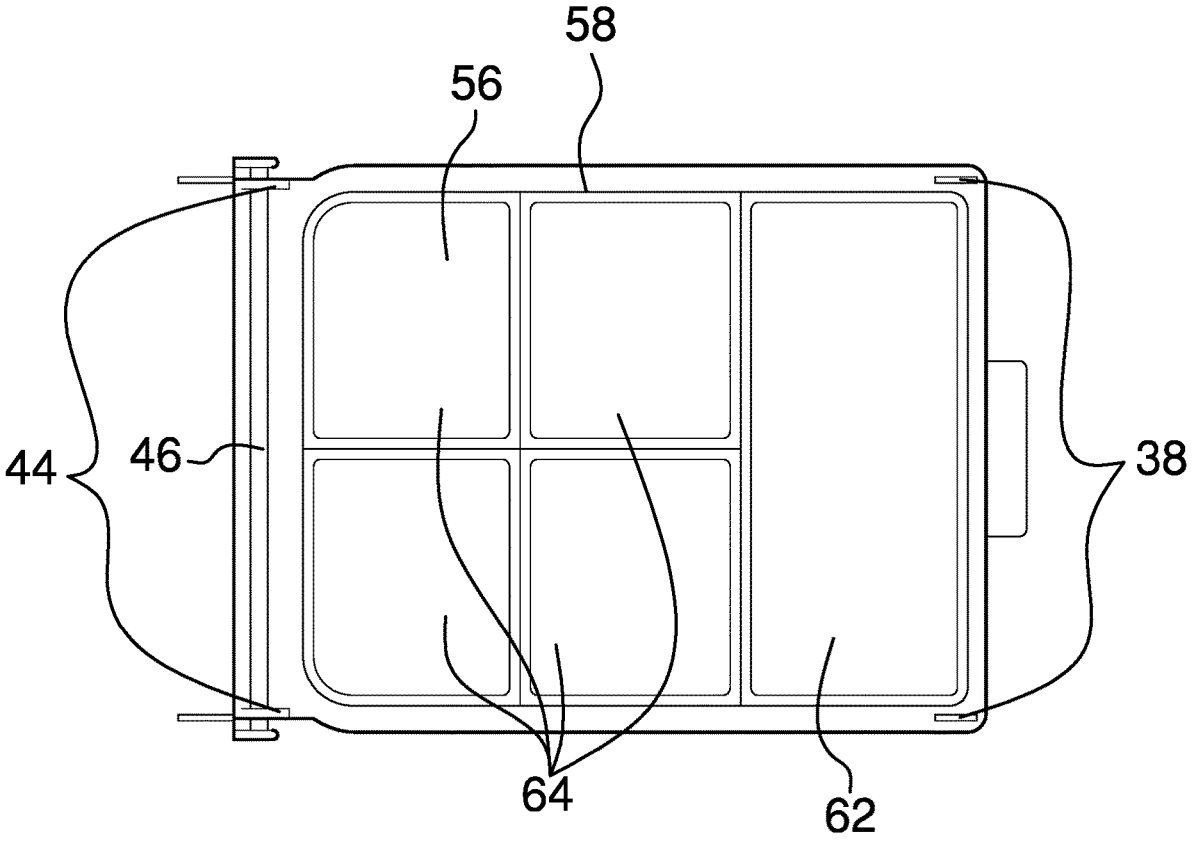
FIG. 2 is a top plan view of an embodiment of the disclosure.
Figure 3:
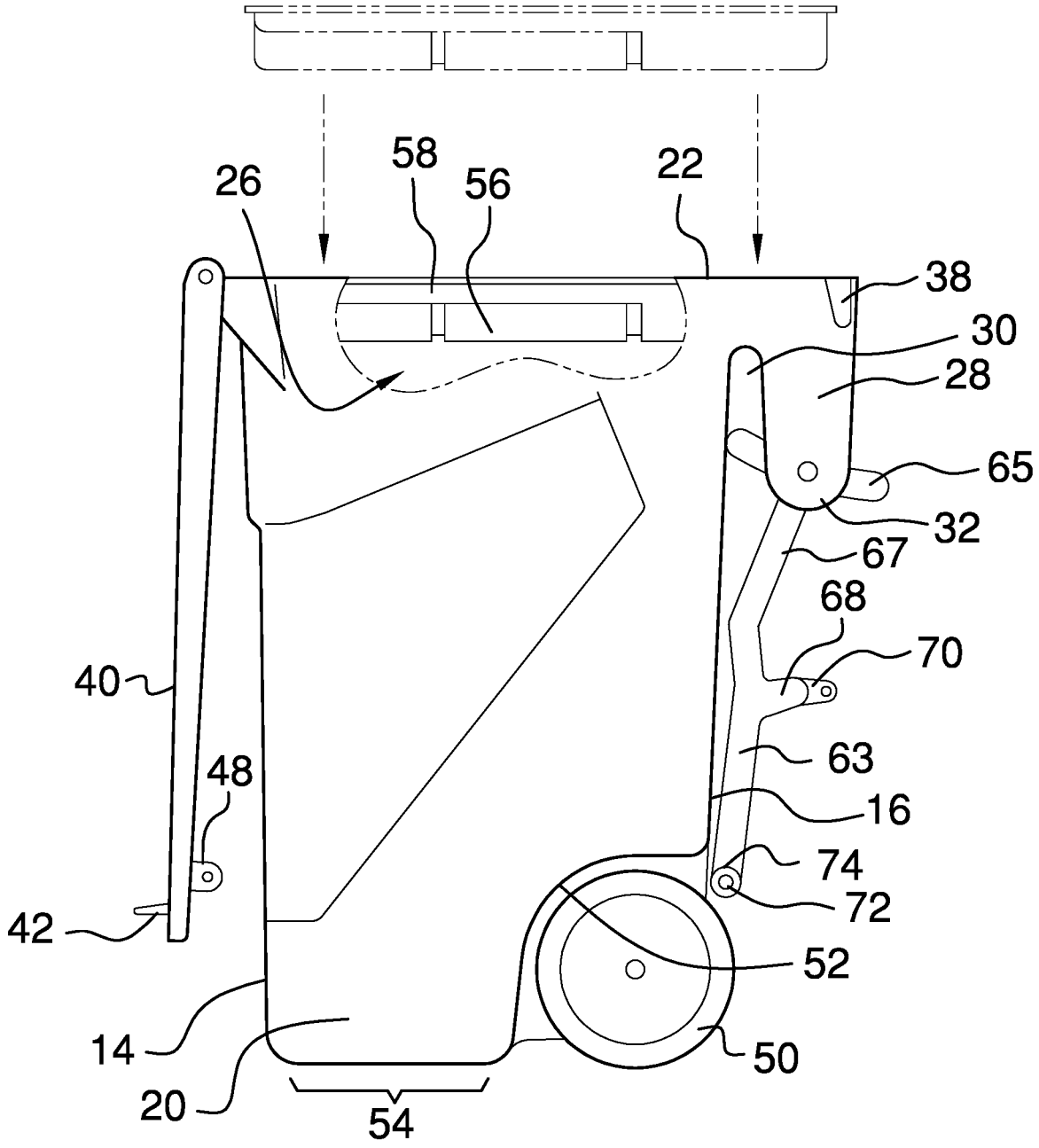
FIG. 3 is a side elevation view of an embodiment of the disclosure.
Figure 4:
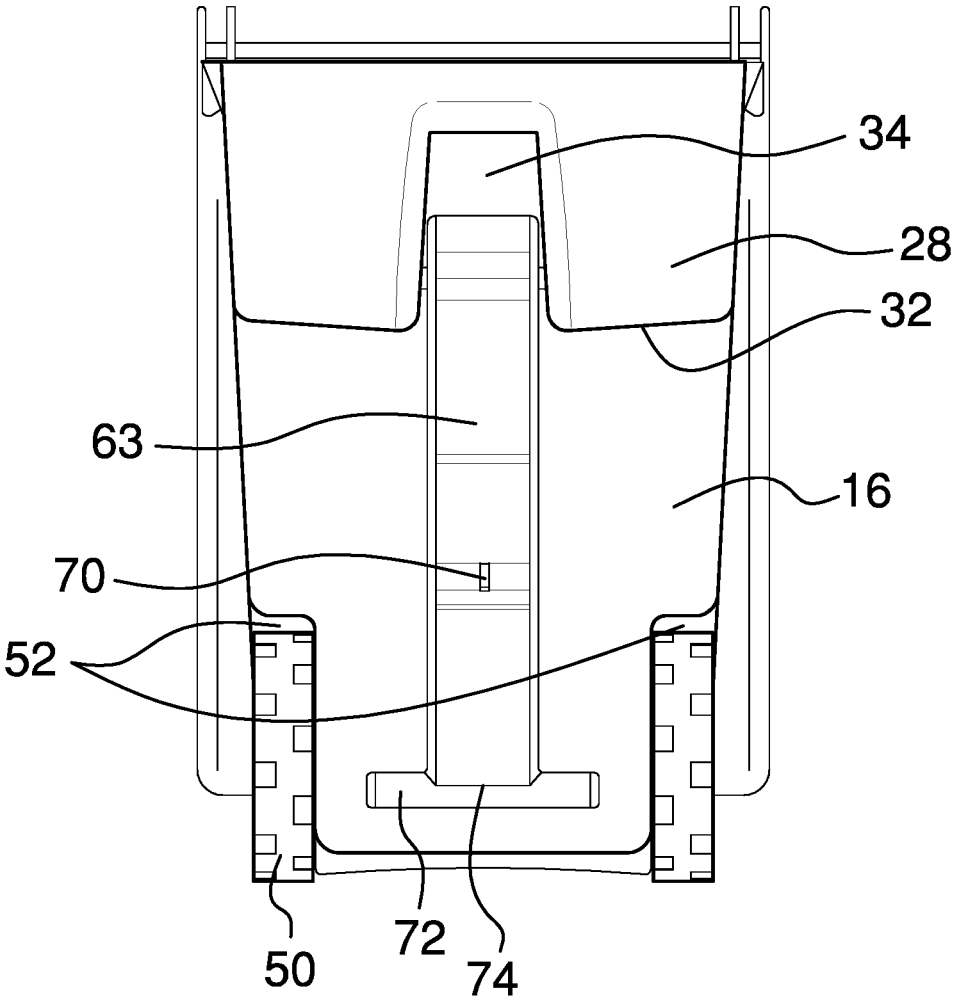
FIG. 4 is a rear elevation view of an embodiment of the disclosure.
Figure 5:
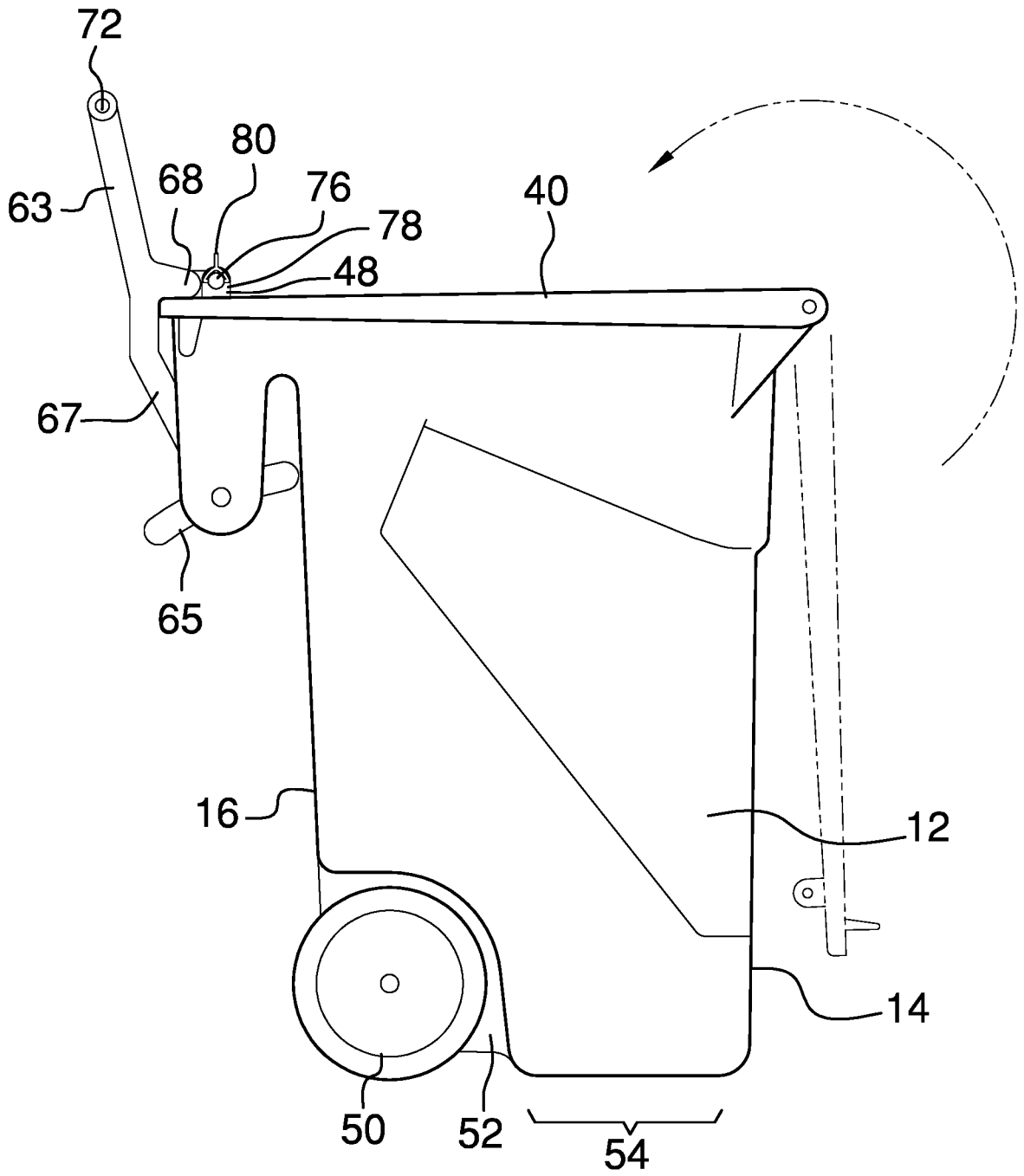
FIG. 5 is a side elevation view of an embodiment of the disclosure.
Figure 6:
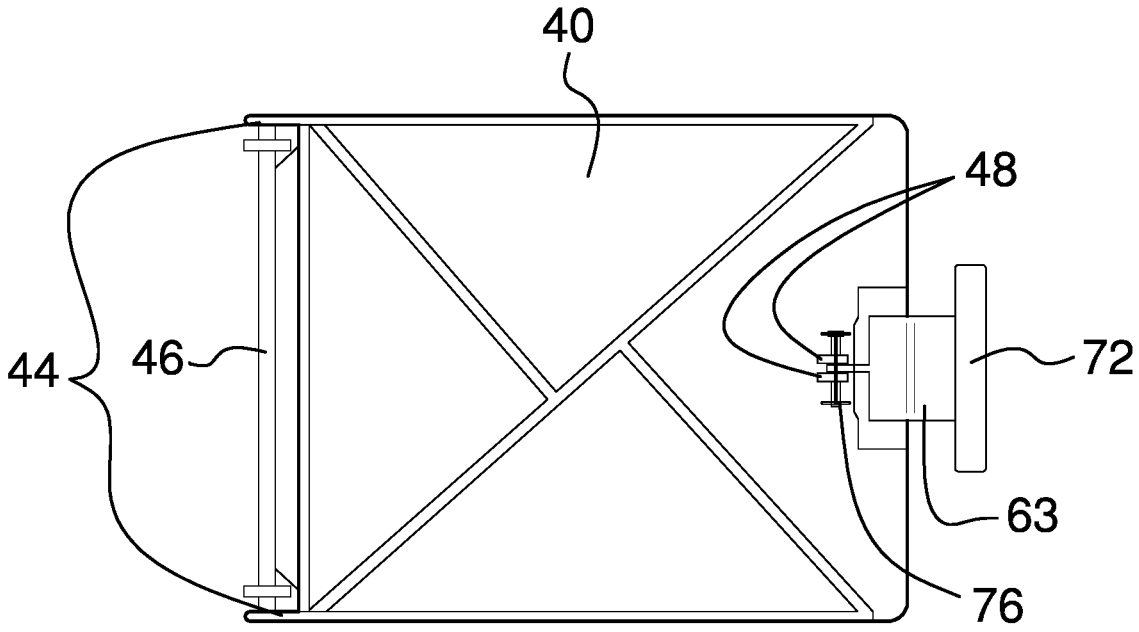
FIG. 6 is a top plan view of an embodiment of the disclosure.
Figure 7:
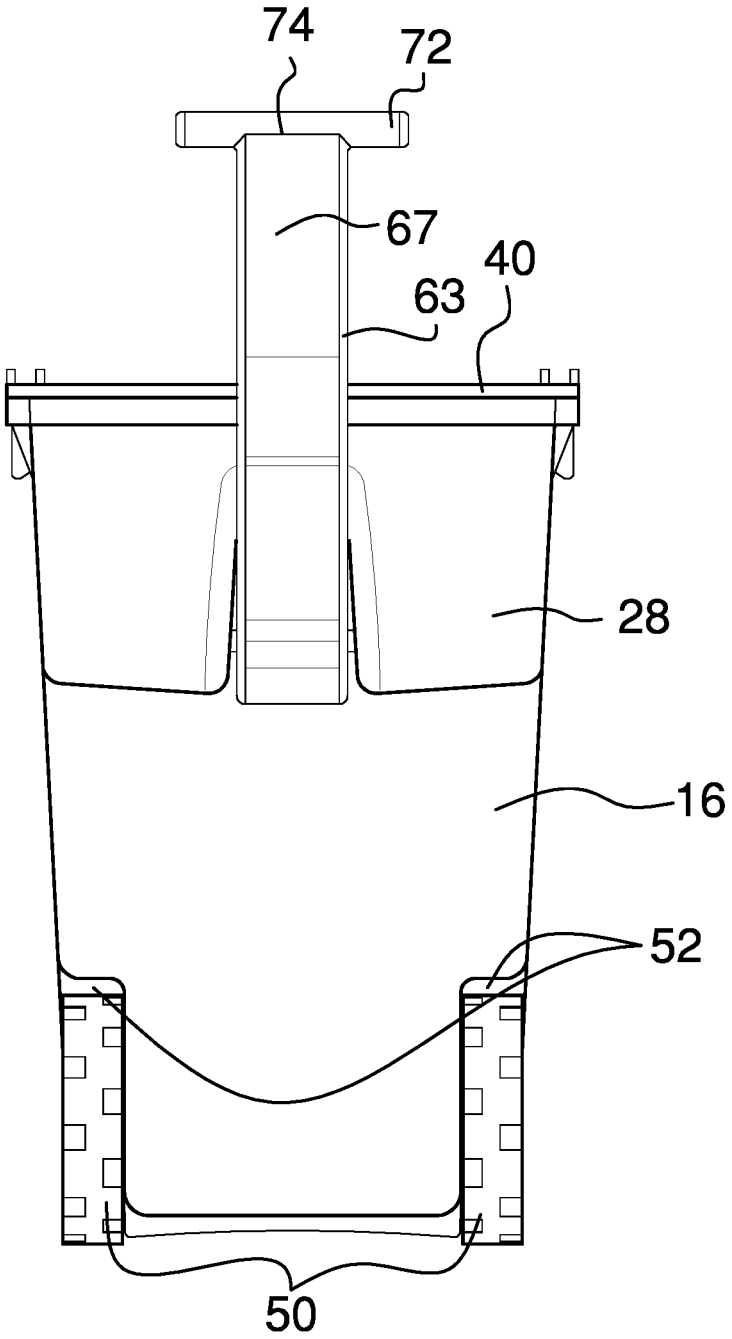
FIG. 7 is a rear elevation view of an embodiment of the disclosure.
Figure 8:
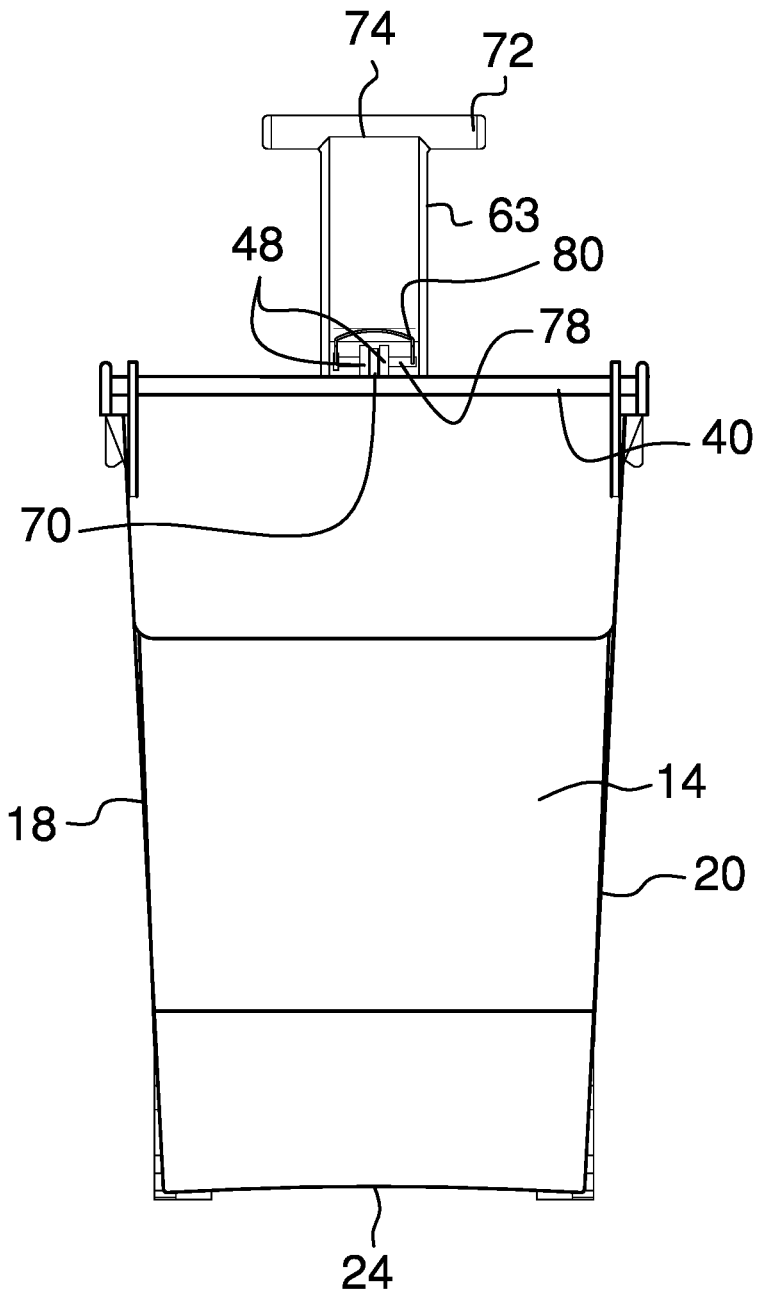
FIG. 8 is a front elevation view of an embodiment of the disclosure.

With reference now to the drawings, and in particular to FIGS. 1 through 9 thereof, a new storage device embodying the principles and concepts of an embodiment of the disclosure and generally designated by the reference numeral 10 will be described.

As best illustrated in FIGS. 1 through 9, the wheeled storage container apparatus 10 generally comprises a body 12 having a body front side 14, a body back side 16, a body left side 18, a body right side 20, an open body top side 22, and a body bottom side 24 defining a body inside 26. The body back side 16 has a drop lip portion 28 extending down from proximal the body top side 22 and defining a catch cavity 30. A drop bottom 32 of the drop lip may be rounded.

Figure 9:
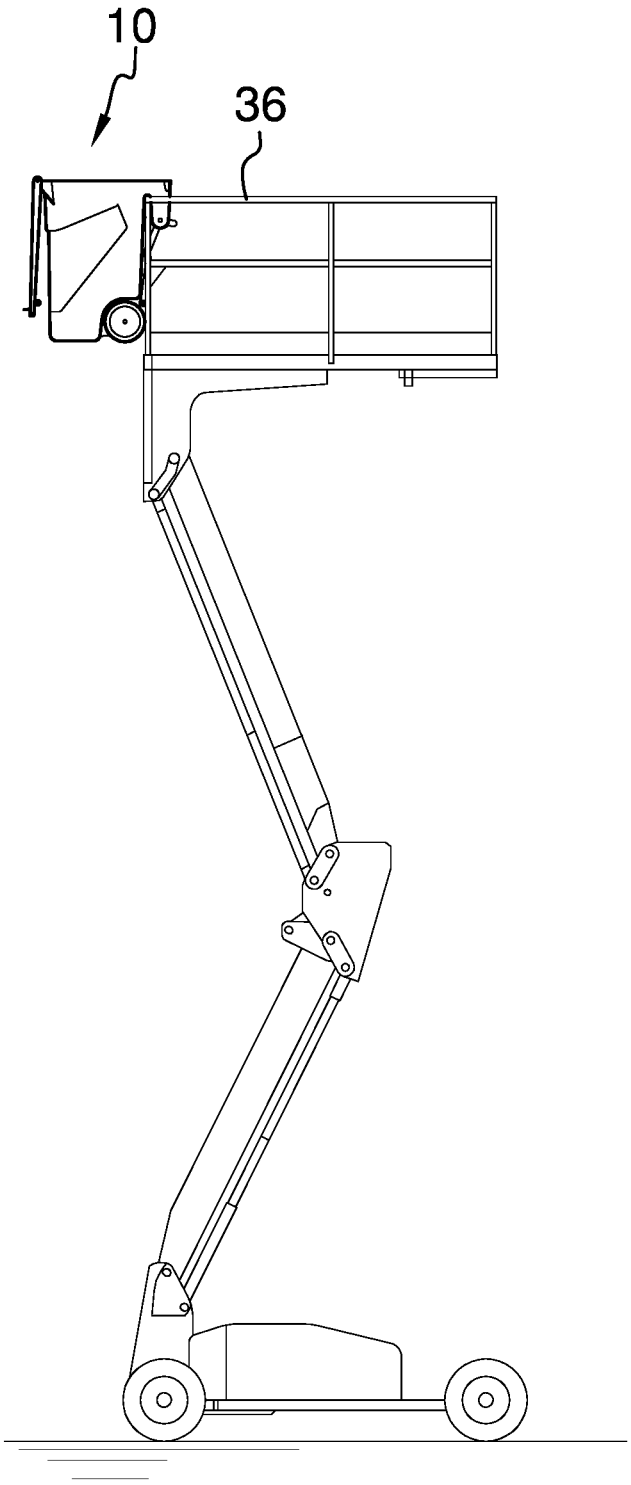
FIG. 9 is an in-use view of an embodiment of the disclosure.

The drop lip portion 28 may have a medial notch portion 34. The catch cavity 30 is configured to hook onto a railing 36 as shown in FIG. 9.

The body top side 22 may have a pair of latch receiving cavities 38 extending into the body left side 18 and the body right side 20. A lid 40 is coupled to the body 12. The lid 40 is hingingly coupled to the body front side 14 to selectively cover or expose the body top side 22. The lid 40 has a pair of latch extensions 42 to selectively engage within the pair of latch receiving cavities 38. The body front side 14 may have a pair of hinge ears 44 extending up above the body top side 22. A support rod 46 may extend between the pair of hinge ears 44. A pair of locking pin ears 48 may be coupled to the lid 40.

A pair of wheels 50 is coupled to the body 12. The pair of wheels 50 is coupled to the body left side 18 and the body right side 20 adjacent the body back side 16. Each of the body left side 18 and the body right side 20 may have a wheel well portion 52 with the pair of wheels 50 being coupled within the wheel well portions 52. Each wheel 50 extends to be aligned with a bottom support portion 54 of the body bottom side and extends past the body back side 16. The housing 12 thus does not roll on the pair of wheels 50 unless it is tilted.

A tray 56 is coupled to the body 12. The tray 56 has a tray rim 58 selectively engageable with the body top side 22 and a plurality of tray compartments 60 extending down into the body inside 26. The plurality of tray compartments 60 may include a wide compartment 62 and a set of four square compartments 64.

A locking arm 63 is coupled to the body 12. The locking arm 63 has a pivot portion 65 pivotably coupled within the medial notch portion 34 of the drop lip portion of the body back side. An arm portion 67 extends from the pivot portion 65 and a catch portion 68 extends from the arm portion 67. The pivot portion 65 may be oriented perpendicularly to a longitudinal axis of the arm portion 67. The catch portion 68 extends from an inner arm face 69 of the arm portion and is selectively engageable with the lid 40 to maintain the lid 40 in a closed position covering the body top side 22. A locking pin tab 70 is coupled to the catch portion 68 of the locking arm. The locking pin tab 70 and the pair of locking pin ears 48 align when the catch portion 68 engages the lid 40. The locking arm 63 may have a handle portion 72 coupled to an arm distal end 74 of the arm portion. The handle portion 72 may be cylindrical and allows for one hand to grip each side to roll the apparatus 10.

A locking pin 76 is selectively engageable with the pair of locking pin ears 48 and the locking pin tab 70 to prevent the lid 40 from opening. The locking pin 76 may have a pin rod portion 78 and a wire portion 80 selectively engageable with the pin rod portion 78 to prevent the locking pin 76 from accidental disengagement.

In use, tools and equipment are stored within the body inside 26 and the tray 56. The handle portion 72 of the locking arm is used to tilt and maneuver the apparatus 10 on the pair of wheels 50. The catch cavity 30 may be engaged with the railing 36 to support the apparatus 10 on a scissor lift. The locking pin 76 is then disengaged and the catch portion 68 is disengaged from the lid 40 to allow access to the tools and equipment as desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wheeled storage container apparatus comprising:

a body having a body front side, a body back side, a body left side, a body right side, an open body top side, and a body bottom side defining a body inside, the body back side having a drop lip portion extending down from the body top side and defining a catch cavity, the catch cavity being configured to hook onto a railing;

a lid coupled to the body, the lid being hingingly coupled to the body front side to selectively cover or expose the body top side;

a pair of wheels coupled to the body, the pair of wheels being coupled to the body left side and the body right side adjacent the body back side, each wheel extending to be aligned with a bottom support portion of the body bottom side and extending past the body back side;

a tray coupled to the body, the tray having a tray rim being selectively engageable with the body top side and a plurality of tray compartments extending down into the body inside; and a locking arm coupled to the body, the locking arm having a pivot portion pivotably coupled to the drop lip portion of the body back side, an arm portion extending from the pivot portion, and a catch portion extending from the arm portion, the catch portion being selectively engageable with the lid to maintain the lid in a closed position covering the body top side.

2. The wheeled storage container apparatus of claim 1 further comprising the body top side having a pair of latch receiving cavities extending into the body left side and the body right side; the lid having a pair of latch extensions being selectively engageable within the pair of latch receiving cavities.

3. The wheeled storage container apparatus of claim 1 further comprising the pivot portion being oriented perpendicularly to a longitudinal axis of the arm portion, the catch portion extending from an inner arm face of the arm portion.

4. The wheeled storage container apparatus of claim 3 further comprising a pair of locking pin ears being coupled to the lid; a locking pin tab coupled to the catch portion of the locking arm, the locking pin tab and the pair of locking pin ears aligning when the catch portion engages the lid; a locking pin being selectively engageable with the pair of locking pin ears and the locking pin tab to prevent the lid from opening.

5. The wheeled storage container apparatus of claim 4 further comprising the locking pin having a pin rod portion and a wire portion selectively engageable with the pin rod portion.

6. The wheeled storage container apparatus of claim 1 further comprising the locking arm having a handle portion coupled to an arm distal end of the arm portion.

7. The wheeled storage container apparatus of claim 6 further comprising the handle portion being cylindrical.

8. The wheeled storage container apparatus of claim 1 further comprising each of the body left side and the body right side having a wheel well portion; the pair of wheels being coupled within the wheel well portions.

9. The wheeled storage container apparatus of claim 1 further comprising the drop lip portion having a medial notch portion, the pivot portion of the locking arm being coupled within the medial notch portion.

10. A wheeled storage container apparatus comprising:

a body having a body front side, a body back side, a body left side, a body right side, an open body top side, and a body bottom side defining a body inside, the body back side having a drop lip portion extending down from the body top side and defining a catch cavity, the drop lip portion having a medial notch portion, the catch cavity being configured to hook onto a railing, the body top side having a pair of latch receiving cavities extending into the body left side and the body right side, each of the body left side and the body right side having a wheel well portion;

a lid coupled to the body, the lid being hingingly coupled to the body front side to selectively cover or expose the body top side, the lid having a pair of latch extensions being selectively engageable within the pair of latch receiving cavities;

a pair of locking pin ears being coupled to the lid;

a pair of wheels coupled to the body, the pair of wheels being coupled to the body left side and the body right side adjacent the body back side, each wheel extending to be aligned with a bottom support portion of the body bottom side and extending past the body back side, the pair of wheels being coupled within the wheel well portions;

a tray coupled to the body, the tray having a tray rim being selectively engageable with the body top side and a plurality of tray compartments extending down into the body inside;

a locking arm coupled to the body, the locking arm having a pivot portion pivotably coupled within the medial notch portion of the drop lip portion of the body back side, an arm portion extending from the pivot portion, and a catch portion extending from the arm portion, the pivot portion being oriented perpendicularly to a longitudinal axis of the arm portion, the catch portion extending from an inner arm face of the arm portion and being selectively engageable with the lid to maintain the lid in a closed position covering the body top side, a locking pin tab coupled to the catch portion of the locking arm, the locking pin tab and the pair of locking pin ears aligning when the catch portion engages the lid, the locking arm having a handle portion coupled to an arm distal end of the arm portion, the handle portion being cylindrical; and a locking pin being selectively engageable with the pair of locking pin ears and the locking pin tab to prevent the lid from opening, the locking pin having a pin rod portion and a wire portion selectively engageable with the pin rod portion.

* * * * *